United States Patent [19]

Büchler

[11] Patent Number: 4,624,440

[45] Date of Patent: Nov. 25, 1986

[54] ADJUSTABLE FORMWORK FOR CONCRETE STRUCTURES

[75] Inventor: Wilhelm Büchler, Haar, Fed. Rep. of Germany

[73] Assignee: Dyckerhoff & Widmann Aktiengesellschaft, Munich, Fed. Rep. of Germany

[21] Appl. No.: 711,614

[22] Filed: Mar. 14, 1985

[30] Foreign Application Priority Data

Mar. 15, 1984 [DE] Fed. Rep. of Germany ..... 3409452

[51] Int. Cl.[4] ..... E04G 9/08

[52] U.S. Cl. ..... 249/194; 249/28; 249/50; 249/159; 249/170

[58] Field of Search ..... 249/1, 10, 11, 50, 159, 249/170, 171, 185, 209, 194, 172, 27, 28, 88

[56] References Cited

U.S. PATENT DOCUMENTS

| | | | |
|---|---|---|---|
| 916,260 | 3/1909 | Briggs | 249/159 |
| 1,233,567 | 7/1917 | Furry | 249/194 |
| 2,674,284 | 4/1954 | Sitton | 249/194 |
| 3,168,771 | 2/1965 | Nelson | 249/50 |
| 4,228,114 | 10/1980 | Alsen et al. | 264/34 |
| 4,279,399 | 7/1981 | Schmucker et al. | 249/170 |

FOREIGN PATENT DOCUMENTS

| | | | |
|---|---|---|---|
| 447678 | 1/1913 | France | 249/170 |
| 1519987 | 4/1968 | France | 249/179 |

*Primary Examiner*—Jay H. Woo
*Assistant Examiner*—James C. Housel
*Attorney, Agent, or Firm*—Toren, McGeady, Stanger, Goldberg & Kiel

[57] ABSTRACT

An adjustable formwork for forming the corner surfaces of concrete structural members includes a first and a second formwork unit. Each formwork unit extends transversely of the other and has a surface which forms one of the concrete surfaces of the concrete structural members and these surfaces define a corner junction line about which the formwork units can be pivotally adjusted relative to one another. One of the formwork units is provided with a circular-arc shaped guide slot and the other has a pair of spaced guide pins secured to it with the pins being movably guided in the slot. The center point of the arc of the slot is located on the corner junction line. The interengagement of the pins with the slot affords a link type guidance between the formwork units. As a result, forces are transmitted at the corner junction line only in the assembly state so that the line lies practically in the plane of the formwork surface which define the concrete surfaces. The forces which occur during loading of the formwork units are transmitted in the region of the junction line between the formwork supports whereby the forces are carried away along the shortest path.

6 Claims, 7 Drawing Figures

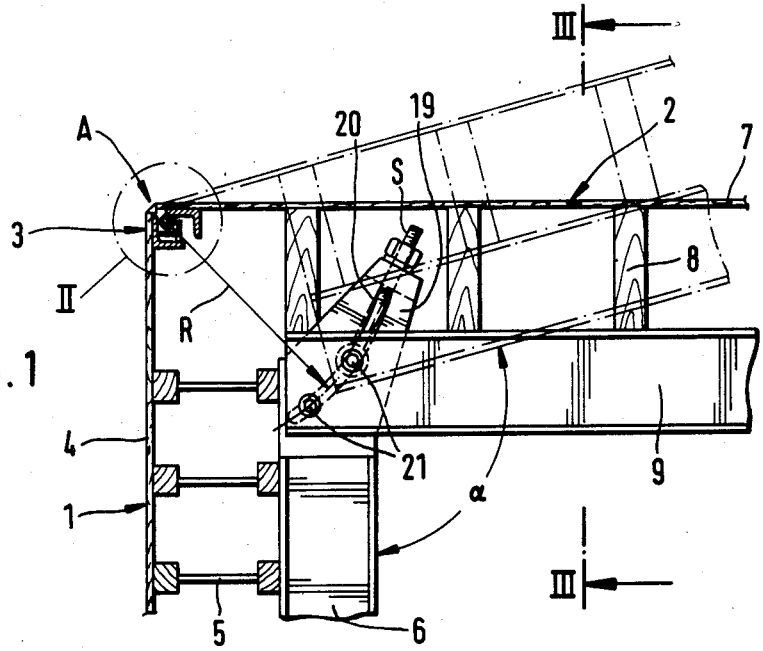
FIG. 1
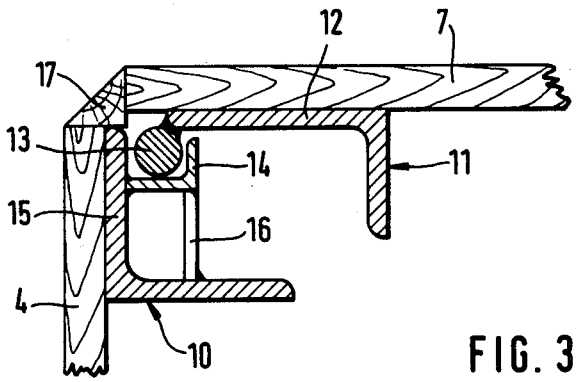
FIG. 2
FIG. 3
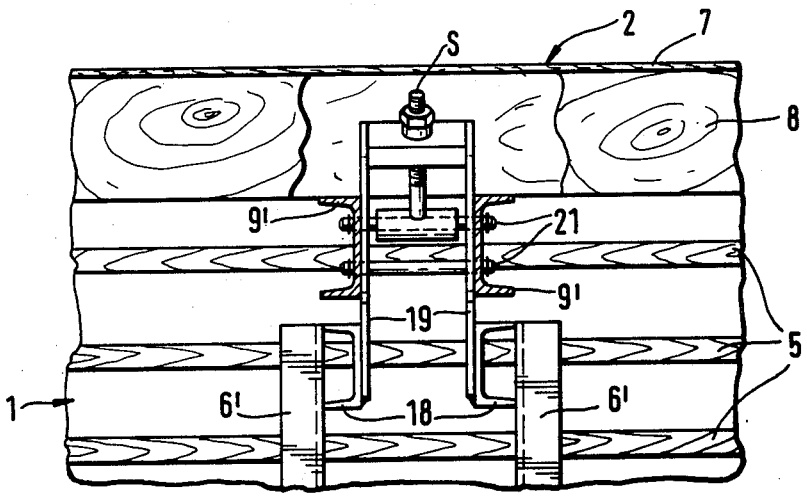

ADJUSTABLE FORMWORK FOR CONCRETE STRUCTURES

BACKGROUND OF THE INVENTION

The present invention is directed to adjustable formwork for forming corner surfaces in concrete structural members. The adjustable formwork includes a pair of formwork units which abut in a corner of the members being formed. The formwork units include formwork supports which extend generally parallel to the concrete surfaces being formed. The formwork supports are connected to one another so that they can be pivotally adjusted and fixed relative to one another.

Formwork for concrete structural members, particularly for members produced in place, such as bridges, include relatively thin planar formwork surfaces which directly form the surface of the structural member. Since the formwork surface, generally a plate-like member, has no great support capacity, it is reinforced or supported by formwork supports. In combination, the formwork surface elements and the formwork supports combine to form formwork units whose position relative to one another can be changed to provide the desired shape of a structural member or to strip the formwork after the concrete has set.

When erecting formwork for so-called inside corners where the concrete surfaces to be poured intersect at an angle less than 180°, there is difficulty in stripping the individual formwork units, from the concrete after it has set, by means of pivotal movements. Pivotal or articulated connections for this purpose are always located in the region of the formwork supports transmitting the force, that is, at a distance from the formwork surface or skin with the result that pivotal movements about such articulation point causes the formwork units to become jammed or siezed in the corner against the concrete which has set. In such formwork there must be some provision for releasing the formwork from a corner which often considerably complicates the construction of the formwork.

Particular difficulties arise, for example, when in the formwork for the underside of a bridge superstructure where the roadway slab is carried by longitudinally extending girders, different angular positions must be maintained along the length of the bridge between the outer surfaces of the girder webs and the lower surface of a roadway slab or of an outwardly projecting cantilever section which forms the roadway slab.

SUMMARY OF THE INVENTION

Therefore, the primary object of the present invention is to develop formwork of the type mentioned above so that when concrete structural parts are formed with surfaces extending at angles to one another, the difficulties mentioned above are avoided and an easier adjustment of the formwork units relative to one another is made possible.

In accordance with the present invention, the formwork units can be pivoted relative to one another about a pivot axis or line extending along the apex of the angle defined between the formwork surfaces or skins. To provide the pivoting action, one of the formwork units defining the junction line at the apex of the angle is provided with a circular arc-shaped guide slot with the arc being centered at the junction line and with at least one guide pin secured to the other formwork unit defining the corner and extending through the guide slot so that the pivotal guidance between the units is afforded in a link type manner.

The guide slot can be provided in a gusset plate connected to the formwork support of one of the formwork units and the units can be adjustably connected to one another by an adjusting element, that is, a spindle arranged approximately tangentially of the guide slot.

The basic concept of the invention is that where two formwork units abut angularly in a corner, the pivotal axis about which the units can be pivotally displaced and the location at which forces are transmitted are separated from one another. Since the pivotal axis has to transmit forces only in the assembly state, that is, before concrete is poured into the formwork, it is possible to displace the pivotal line practically to the plane of the formwork surface, that is, at the apex of the angle formed by the formwork surfaces of the two formwork units defining the corner. The forces occurring when concrete is poured into the formwork are transmitted in the region of the junction or pivotal line between the formwork supports of the two formwork units and, accordingly, such forces are carried away along the shortest path.

The arrangement of the formwork units provides them with the ability to be angularly displaced relative to one another over an angular range, because the adjustment is provided by the location of the pivotal axis disposed approximately at the apex of the angle defined by the corner formed by the formwork units.

When formwork of this type is used for bridge superstructures with a slab carried by longitudinal girders, using a generally vertically extending formwork unit for the side of the girder web and a generally horizontal formwork unit for the slab, the formwork supports for the vertical formwork unit and possibly additional supports for the horizontal formwork unit are supported relative to a lower support arrangement so that they can be pivoted in a parallelogram-like manner.

The formwork supports for the vertical formwork unit and the supports for the horizontal formwork unit can be guided on support frames, such as trestles, so that they can be displaced in the longitudinal direction and the support frames can be secured in an articulated manner at a lower support frame surface.

To pivot such a formwork unit an adjusting element, such as a piston cylinder unit, can be connected in an articulated or pivoted manner to the vertical support of the vertical formwork unit and also to the lower support.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is a cross-sectional view through a formwork arrangement embodying the present invention arranged to form an inside corner of a concrete structural member;

FIG. 2 is a detail II as shown in FIG. 1 and illustrated on an enlarged scale;

FIG. 3 is a sectional view taken along the line III—III in FIG. 1;

DETAILED DESCRIPTION OF THE INVENTION

Figure 4:
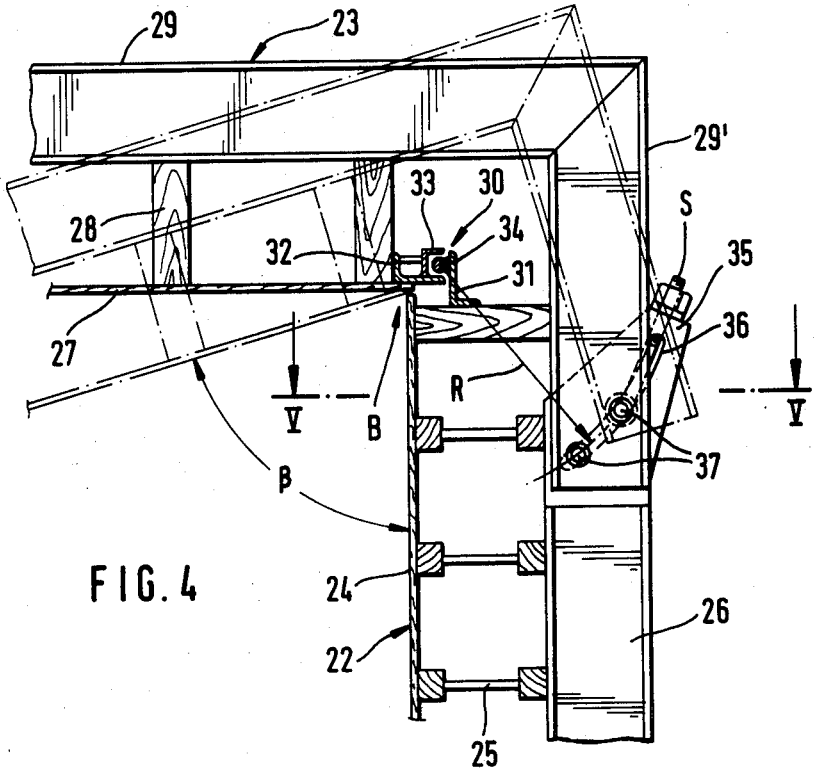
FIG. 4 is a cross-sectional view, similar to FIG. 1, through a formwork arrangement embodying the present invention for forming an outside corner of a concrete structural member.

FIGS. 1, 2 and 3 illustrate one embodiment of an adjustable formwork arrangement, according to the present invention, which can be used for forming a so-called inside corner or angle of a concrete structural member, such as the corner between the outer surface of a longitudinal girder in a bridge support arrangement and the underside of a roadway slab located along the upper side of the girder.

In FIG. 1 the corner is designated with A and is formed by a vertical formwork unit 1 and a horizontal formwork unit 2 which abut along a pivot axis 3 closely adjacent the apex of the angle formed by the formwork units. The planar surface or skin 4 of the vertical formwork unit 1 is supported by stiffeners 5 supported against vertical formwork supports or posts 6 extending at right angles to the stiffeners. The stiffeners are disposed in spaced relation relative to one another as are the supports 6. Similarly, the formwork surface or skin 7 of the horizontal formwork unit 2 is supported on stiffeners 8 bearing, in turn, on horizontal supports or beams 9. The formwork surface or skin 4 and 7 can be formed of various plate-like members known per se.

The axis or line 3 affording the pivotal movement between the two formwork units 1, 2 is shown in FIG. 2 providing a detail II of the encircled portion in FIG. 1. A structural steel angle 10 is secured at the upper end of the formwork surface 4 of the vertical formwork unit 1, that is, the side of the formwork surface or skin 4 opposite the side which contacts the concrete. Another structural steel angle 11 is secured to the adjacent outer end of the formwork skin 7 on the horizontal formwork unit 2 so that one leg of the angle contacts the formwork skin on the opposite side from the concrete with the other leg projecting from the formwork skin. Accordingly, the angles 10 and 11 approximately enclose a rectangle. A round rod or pin 13 forming the pivot axis, is welded to the end of the leg 12 of the angle 11, that is, the leg which bears against the formwork skin 7. The round pin 13 is rotatably mounted in a kind of bearing bush formed from a smaller structural steel angle 14 and welded to the surface of the leg 15 of the angle 10, that is, the leg which bears against the formwork skin 4. The angle 14 is welded so that one of its legs abuts against the leg 15 at a right angle. A support 16 is welded at its lower end to the angle 10 and at its upper end to the angle 14 for stabilizing the bearing formwork. As can be noted in greater detail in FIG. 2, there is a space between the adjacent edges of the formwork surfaces or skins 4, 7 and it is filled by a triangularly shaped corner fillet 17.

In FIG. 3 the arrangement of the articulated connection of the vertical formwork supports 6 and the horizontal formwork supports 9 are shown along the section III—III of FIG. 1. The vertical formwork supports 6 are made up of structural steel channels 6', that is, U-shaped sections, arranged in laterally spaced pairs with gusset plates 19 fastened to the supports by short transversely extending channel sections 18 extending between the supports 6' and the plates 19. Each of the laterally spaced gusset plates 19 has a guide slot 20, note FIG. 1, which extends along a circular arc having a radius R corresponding to the distance from the pivot axis 3 to the slot. A pair of guide pins, disposed in spaced relation, extend through boreholes in the horizontal formwork support 9 and also through the guide slot 20. The formwork support 9, similar to the vertical formwork support 6, is made up of two structural steel channel sections 9' with the legs of the channels directed outwardly away from one another and with the webs of the channels 9' bearing against the outer surfaces of the gusset plates 19.

In this way, the horizontal formwork supports 9 and with them the horizontal formwork unit 2 can be pivoted about the pivot axis 3 at an angle $\alpha$ with the guide pins 21 sliding in the guide slot 20. The pivotally displaced position of the formwork unit 2 is shown in dashed lines in FIG. 1. To fix the positions of the formwork units relative to one another after the desired adjustment so that the formwork can absorb loads during the concreting operation, an adjusting element in the form of a spindle S made up of a threaded bolt and a nut is arranged between the horizontal formwork supports 9 and the gusset plates 19. By means of the spindle S, that is, by actuating the nut on the threaded bolt, the formwork unit 2 can be pivoted upwardly around the pivot axis 3 and it can also be pivoted downwardly at a smaller angle $\alpha$ in order to release the formwork without having the formwork surface 7 become jammed against the concrete after it has set in the region of the corner A.

Figure 5:
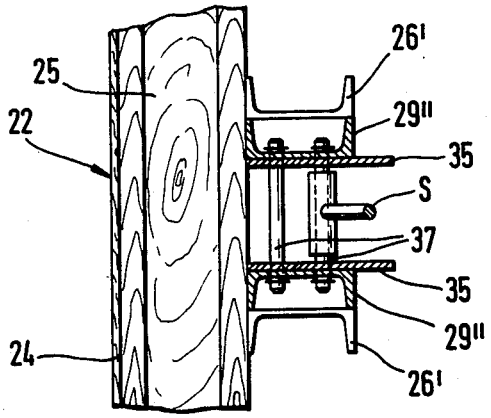
FIG. 5 is a sectional view taken along the line V—V in FIG. 4.

FIGS. 4 and 5 show another formwork embodiment, similar to FIGS. 1 and 3, but illustrating an arrangement for forming an outside corner where the formwork supports are spaced outwardly from the concrete. The formwork arrangement includes a vertical formwork unit 22 and a horizontal formwork unit 23 which abut to form a corner B. Vertical formwork unit 22 includes a formwork surface or skin 24 supported by stiffeners 25 which, in turn, bear against vertical supports 26. Horizontal formwork unit 23 includes a formwork surface or skin 27 bearing against stiffeners 28, in turn, bearing against horizontal formwork supports 29. The formwork supports 29 extend around the corner B with right-angled support projections 29' extending downwardly from the supports 29 into closely spaced relation with the vertical formwork supports 26.

The pivotal axis 30 is similar to the axis 3 and is formed by two structural steel angles 31, 32 each fastened to a different one of the formwork units 22, 23. In addition, a smaller angle 33 is associated with the angles 31, 32 and forms a bearing bushing for a round rod or pin 34 serving as the pivot axis.

With the provision of structural steel channels, not shown in this embodiment, gusset plates 35, each of which has a circular arc-shaped guide slot 36, are secured to the vertical formwork supports 26 which, as in the embodiment shown in FIG. 3, are formed of channel sections 26' arranged in spaced pairs. A pair of guide bolts 37, disposed in spaced relation, are guided in the laterally spaced guide slots 36 with the guide bolts 37 connecting a pair of channel sections 29'' which form the horizontal formwork support 29 and extend angularly around the corner B with the support projections 29'.

Figure 6:
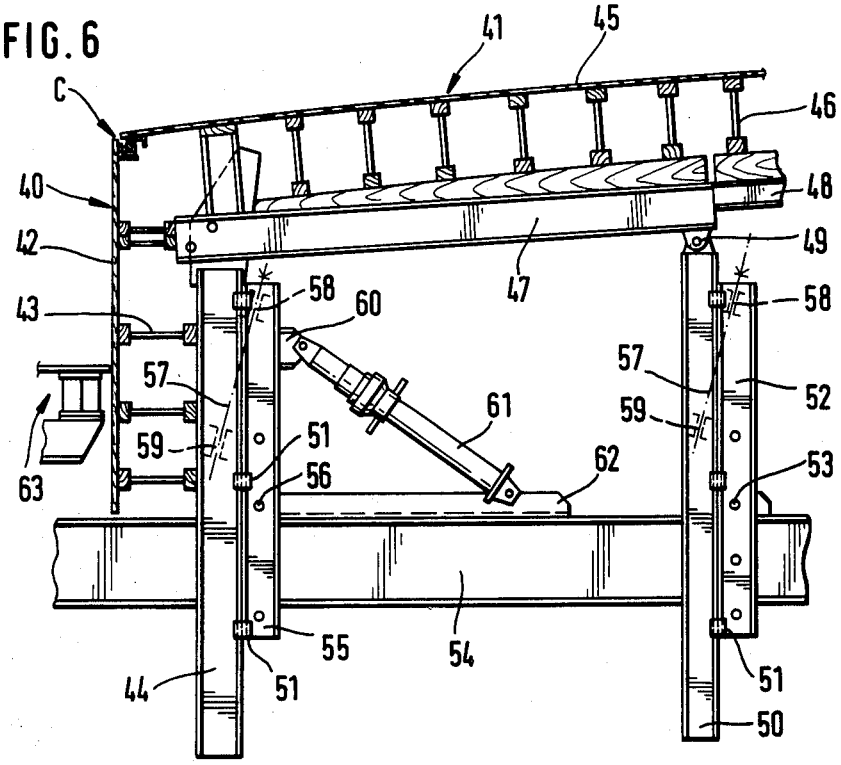
FIG. 6 is a cross-sectional view of a formwork arrangement, embodying the present invention, for forming the underside of a bridge roadway slab and the side surface of a girder.
Figure 7:
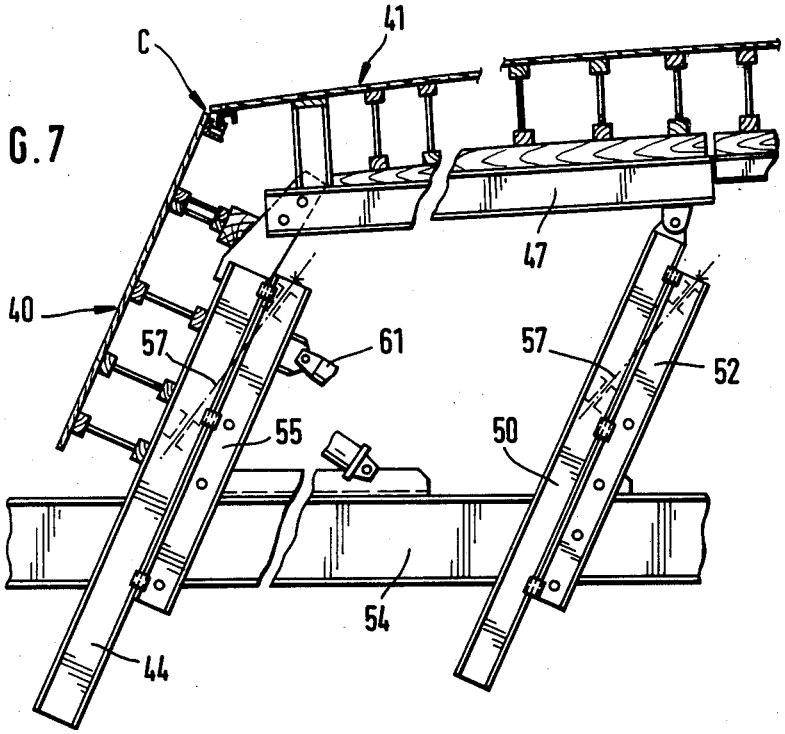
FIG. 7 is a sectional view, similar to FIG. 6, showing the formwork arrangement in a pivotally displaced state.

As indicated in FIG. 4 in dashed lines, the upper or horizontally arranged formwork unit 23 can be pivoted about the pivot axis 30 through an angle $\beta$ relative to the surface 24 of the upwardly extending formwork unit 22. As a result, the guide bolts 37 move along a circular arc within the guide slots 36 with the arc having a radius R centered at the pivotal axis 30. The adjustment of the formwork units and the securement of such units for transmitting concreting loads is effected by an adjusting member, that is, the spindle S arranged between the gusset plates 35 secured to the formwork supports. A particularly favorable embodiment of the formwork in accordance with the present invention for an inside corner, as shown in FIGS. 1–3, is illustrated in FIGS. 6 and 7 showing a formwork arrangement for the underside of a bridge structure for forming the concrete surfaces located on the outer surface of a longitudinal girder web and the lower surface of a roadway slab. As a rule, in bridge structures with a T-shaped arrangement of the support and the slab or a box-type construction, the formwork for the corners between the longitudinal girder webs and the roadway slab, particularly where the slab cantilevers outwardly from the girder, problems occur if the height of the longitudinal girder webs vary or if the slope of the lower surface of the roadway slab changes relative to the upwardly extending webs of the girder.

The formwork illustrated in FIGS. 6 and 7 displays an upwardly extending formwork unit 40 for the side of a girder web and a generally horizontally extending formwork unit 41 for the underside of an adjoining roadway slab. Formwork unit 40 for forming the web has a surface or skin 42 supported by stiffeners 43 off vertical supports 44. In a similar manner, the cantilevered roadway slab is provided by the formwork unit 41 having an upwardly facing formwork skin 45 supported on a transverse girder 47 with stiffeners 46 extending between the girder 47 and the formwork surface. The transversely extending girder 47 may be continued by an auxiliary girder 48 which affords support for the formwork surface 45 laterally outwardly from the girder 47.

The upper transverse girder 47 in the region of its intersection with the vertical formwork support 44, as well as the formwork surface 42 arranged to form the side surface of the web on the formwork unit 40 and the formwork surface 45 on the generally horizontally arranged formwork unit 41 are connected together about a pivot axis C similar to the arrangement shown in FIGS. 1–3. The upper generally horizontally arranged support girder 47 is connected in a pivotal manner about a pivot axis 49 located at the upper end of a vertical support 50. Support 50 is guided by guides 51 so that it is displaceable in its long direction relative to a support frame 52 articulated about a pivot point 53 on the horizontally arranged girder 54 of a lower support construction. In a similar manner, the vertical formwork support 44 is guided on a support frame 55 by guides 51 and the support frame 55 is also supported at the transverse girder 54 of the lower support arrangement so that it can be pivoted about an axis 56. The upwardly extending support 50 is connected to the support frame 52 and the upwardly extending formwork support 44 is connected with the support frame 55 by spindles 57 arranged, in each instance, between an upper bearing block 58 and a lower bearing block 59 so that the generally vertically extending and generally horizontally extending formwork units can be pivoted relative to one another via the guides 51. For the sake of clarity, the spindles, known per se, are indicated only by their axes.

As can be seen in FIG. 6, an adjusting element 61, such as a cylinder-piston unit, is pivoted to the support 55 by a bracket 60 and the adjusting element is connected at its opposite end in a pivotal manner to a lower support 62 secured to the transverse girder 54 of the lower support arrangement.

As can be seen from FIG. 7, it is possible, by means of the adjusting element 61, to vary the angle between the formwork units 40, 41 whereby pivotal movement takes place between these units at the pivot axis C. At the same time, the actuation of the spindles 57 effect a change in the height of the formwork units 40, 41 relative to the lower support arrangement or relative to the base formwork 63 of a bridge girder, note FIG. 6.

While specific embodiments of the invention have been shown and described in detail to illustrate the application of the inventive principles, it will be understood that the invention may be embodied otherwise without departing from such principles.

I claim:

1. Adjustable formwork for forming corner surfaces of concrete structural members comprising a first formwork unit and a separate second formwork unit each arranged to extend generally parallel to the surface of the concrete structural member being formed and to extend angularly relative to one another, said first and second formwork units including surfaces to form the corner surfaces of the concrete structural members being formed, said first and second formwork units being connected whereby said units can be adjustably displaced and fixed relative to one another, wherein the improvement comprises that said surfaces of said first and second formwork units form a corner junction line approximately defining the apex of the angle between the surfaces of the concrete structural members being formed, and said corner junction line forms a pivot axis for pivotally adjusting said formwork units relative to one another, one of said first and second formwork units having a circular arc-shaped guide slot therein with the circular arc being centered on the corner junction line, two guide pins disposed in spaced parallel relation and secured to the other one of said first and second formwork units and extending through and being movably guided within and along said circular arc-shaped guide slot affording a link guidance for the pivotal movement of said first and second formwork units relative to one another, an adjustment element is secured to the one of said first and second formwork units and is secured to one of said guide pins within said guide slot in the other one of said first and second formwork units so that said first and second framework units can be pivotally adjusted relative to one another whereby the angle between said surfaces forming the corner surfaces can be selectively increased or decreased relative to the angle formed by said surfaces in position to form the corner surfaces of the concrete member, said adjustment element comprises a spindle secured to the one of said first and second formwork units containing said guide slot with said spindle extending approximately tangentially of said guide slot, said spindle comprises a threaded bolt secured to said one guide pin with a nut mounted on said threaded bolt and arranged for axially displacing said threaded bolt as said nut is rotated thereon.

2. Adjustable formwork, as set forth in claim 1, wherein each of said first and second formwork units includes formwork supports, at least one gusset plate secured to one of said formwork supports and containing said guide slot.

3. Adjustable formwork, as set forth in claim 1, wherein said formwork is used for forming a bridge superstructure with elongated girders and a roadway slab supported on said girders, said first formwork unit is a generally vertically extending unit for forming a side of the girder and said second formwork unit is a generally horizontally extending formwork unit for forming the undersurface of the slab, support means provided for said first and second formwork units so that said first and second formwork units are pivotally displaceable relative to one another.

4. Adjustable formwork, as set forth in claim 3, wherein said support means comprises a generally upwardly extending first support frame for said first formwork unit, an upwardly extending second support frame for said second formwork unit disposed in spaced parallel relation with said first support frame, and a sub-support for both of said first and second support frames with said first and second support frames being pivotally secured to said sub-support.

5. Adjustable formwork, as set forth in claim 4, wherein adjustment means is pivotally secured to said sub-support and to one of said first and second support frames at a position spaced from said pivotal connected to said sub-support whereby said adjustment means affords the displacement of said first and second formwork units including said first and second support frames in a parallelogram-like manner.

6. Adjustable formwork, as set forth in claim 5, wherein said adjustment means comprises an axially elongated cylinder-piston unit pivotally connected at one end to said sub-support and at the other end to said first support frame.

* * * * *